US007255468B2

(12) United States Patent
Capriola

(10) Patent No.: US 7,255,468 B2
(45) Date of Patent: Aug. 14, 2007

(54) ILLUMINATED SHOES AND ILLUMINATED FASHION ACCESSORIES

(76) Inventor: Jonathan Capriola, 4374 S. Lockwood Ridge Rd., Sarasota, FL (US) 34231

( * ) Notice: Subject to any disclaimer, the term of this patent is extended or adjusted under 35 U.S.C. 154(b) by 136 days.

(21) Appl. No.: 11/132,706

(22) Filed: May 19, 2005

(65) Prior Publication Data

US 2006/0002134 A1 Jan. 5, 2006

Related U.S. Application Data

(60) Provisional application No. 60/572,733, filed on May 20, 2004, provisional application No. 60/633,748, filed on Dec. 7, 2004.

(51) Int. Cl.
*A43B 5/00* (2006.01)

(52) U.S. Cl. ..... 362/570; 362/103; 362/581; 36/137

(58) Field of Classification Search ..... 362/103, 362/570, 581; 36/137
See application file for complete search history.

(56) References Cited

U.S. PATENT DOCUMENTS 5,430,621 A * 7/1995 Raskas ..... 362/570
5,502,903 A * 4/1996 Barker ..... 362/103

* cited by examiner

*Primary Examiner*—Stephen F Husar
(74) *Attorney, Agent, or Firm*—QuickPatents, Inc.; Kevin Prince

(57) ABSTRACT

An apparatus for illuminating shoes and fashion accessories includes a fiber optic cable, a clasp and a control circuit. The fiber optic cable has a first coupling point and a second coupling point. The clasp has a housing, a retention mechanism, a first connector and a second connector. The first connector is configured to couple to the first coupling point and the second connector is configured to couple to the second coupling point of the fiber optic cable. The control circuit is disposed within the housing and has a power source and at least one illuminating device. The illuminating device is optically coupled to one or both of the first and second connectors in order to illuminate at least a portion of the fiber optic cable with light. At least one of the clasp and the illuminating device is removable to permit interchangeable selectivity of the color of the illuminating light.

8 Claims, 22 Drawing Sheets

ILLUMINATED SHOES AND ILLUMINATED FASHION ACCESSORIES

CROSS REFERENCE TO RELATED APPLICATIONS

This application claims the benefit of U.S. Provisional Application Nos. 60/572,733 filed on May 20, 2004 and 60/633,748 filed on Dec. 7, 2004.

BACKGROUND OF THE INVENTION

The present invention relates generally to a method and apparatus for illuminating shoes and fashion accessories, and more particularly, to an electronic control circuit, apparatuses and methods for illuminating optical fibers and the like disposed in or on shoes, shoe accessories or other fashion accessories.

It is known in the art to provide a flashing light(s) or flashing light emitting diode(s) (LED) in the sole of a sneaker or shoe to give the effect that the soles are flashing when the user is walking. However, these lighted shoes provide only a blinking light or lights in the sole. Further, it is known in the art to provide a continuous or flashing LED as a decoration on shoes such as directly on the tips of the straps and sides of the shoe.

It is also known to provide electroluminescent material within a cord to use as a decoration, jewelry, on clothing and as shoe laces. However, a limitation with the electroluminescent material is that the color of the emitted light is dictated by the material itself which is deposited within the cord itself, thereby requiring that the entire cord be changed to change colors. Additional, there are limited color choices available in electroluminescent material.

It is desirable to provide a device that can illuminate laces and/or trim of shoes. Further, it is desirable to provide a device that can function both as an illuminating device and the laces and/or trim of shoes with an interchangeable color light source and/or color lens for the light source. Even further, it is desirable to provide a device that can function both as an illuminating device and the straps/ties/thongs of a sandal or shoe and any other part of a shoe.

BRIEF SUMMARY OF THE INVENTION

Briefly stated, the present invention comprises an apparatus for illuminating shoes and fashion accessories that includes a fiber optic cable, a clasp and a control circuit. The fiber optic cable has a first coupling point and a second coupling point. The clasp has a housing, a retention mechanism, a first connector and a second connector. The first connector is configured to couple to the first coupling point of the fiber optic cable and the second connector is configured to couple to the second coupling point of the fiber optic cable. The control circuit is disposed within the housing and has a power source and at least one illuminating device. The at least one illuminating device is optically coupled to one of or both of the first and second connectors in order to illuminate at least a portion of the fiber optic cable with light. At least one of the clasp and the illuminating device is removable to permit interchangeable selectivity of the color of the illuminating light.

The present invention also comprises an illuminated shoe. The illuminated shoe includes an optically conductive material partially forming at least one structural component of the shoe and a light source that is optically coupled to the optically conductive material. The illuminated shoe also includes a control circuit disposed on or within the shoe. The control circuit is electrically or optically coupled to the light source to selectively illuminate the light source which in turn illuminates the optically conductive material.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In The Drawings:

FIGS. 1, 1A and 1B are perspective views of an apparatus for illuminating shoes in accordance with a first preferred embodiment of the present invention mounted on a tennis shoe and enlarged views of the apparatus;

DETAILED DESCRIPTION OF THE INVENTION

Figure 1B:
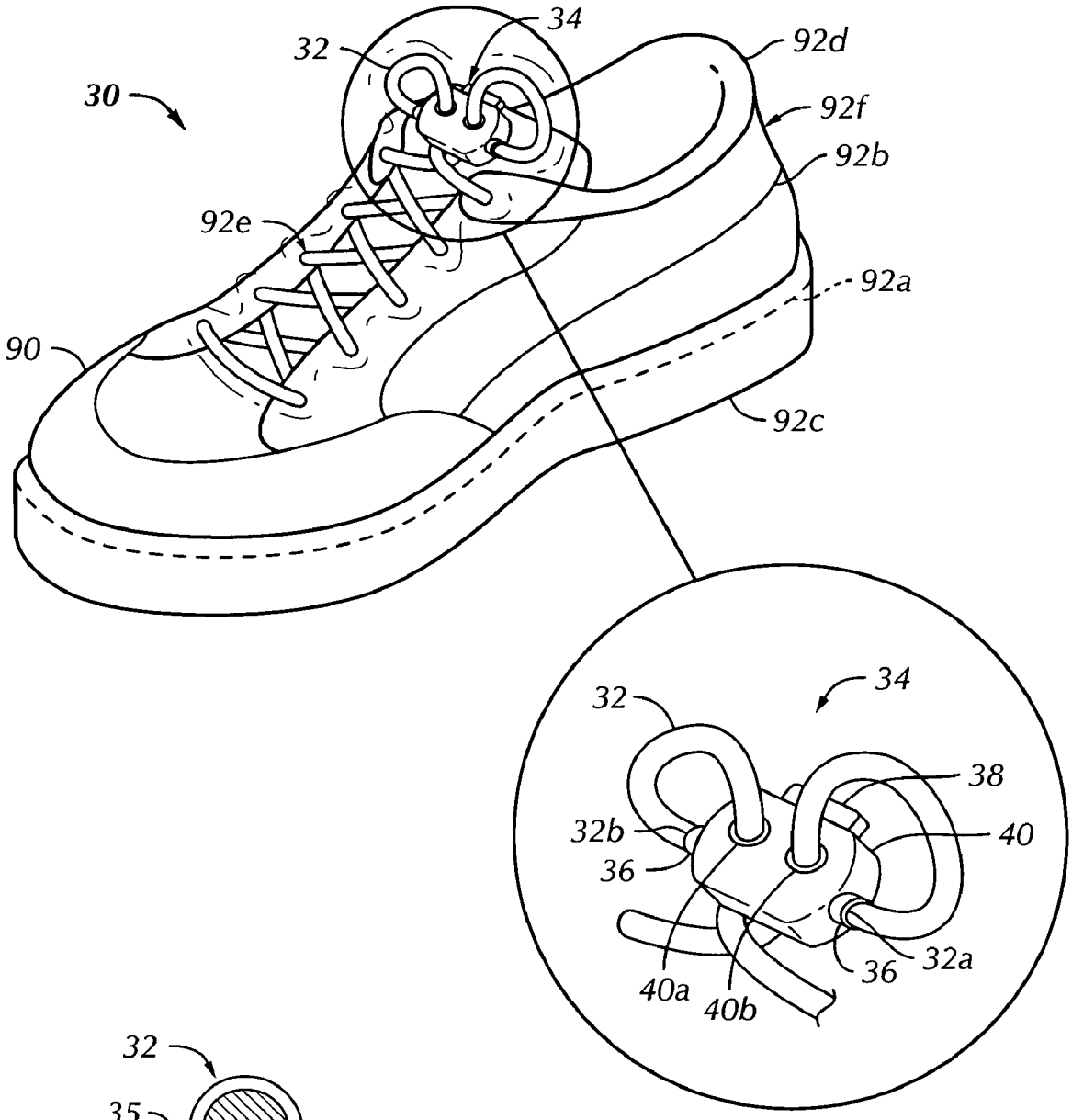
Figure 1A:
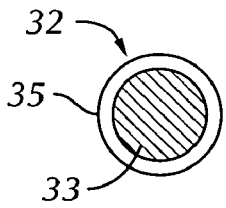
Figure 2:
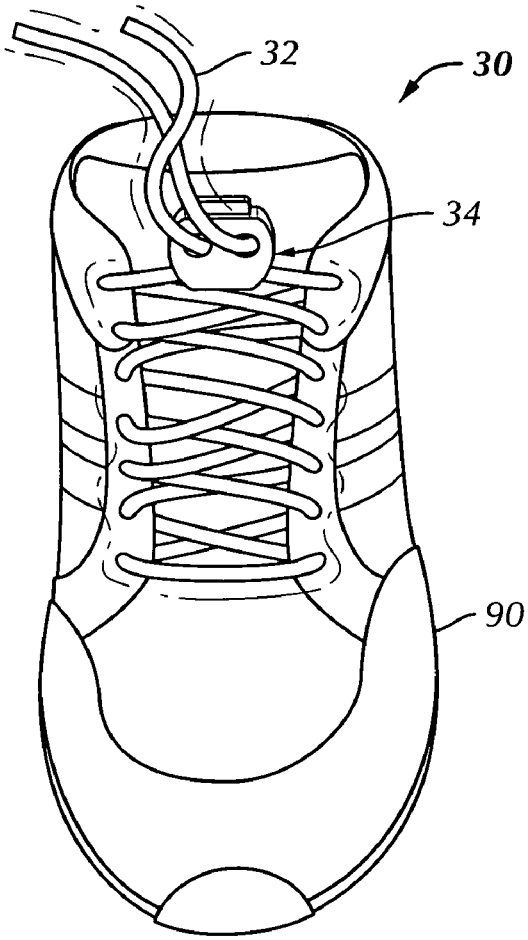
FIG. 2 is a photograph of the apparatus for illuminating shoes of FIG. 1 in an illuminated state mounted on a tennis shoe in an "untied" configuration.
Figure 3A:
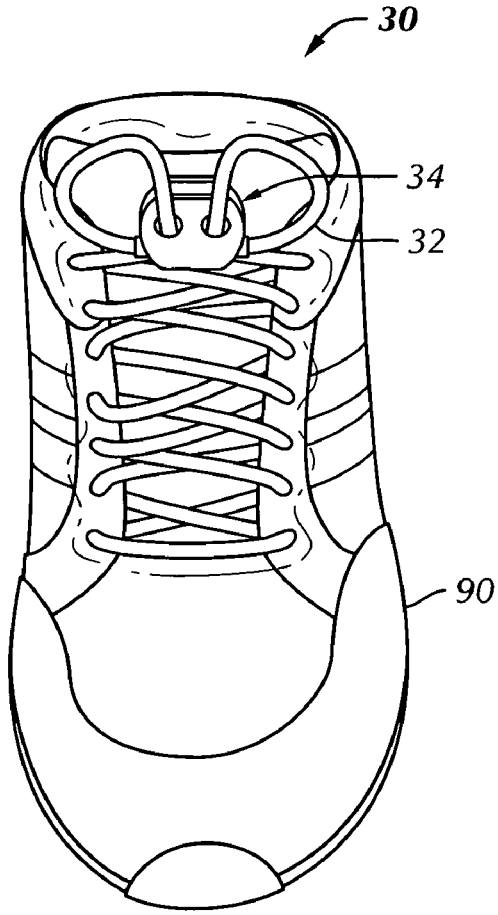
FIG. 3A is a perspective view of the apparatus for illuminating shoes of FIG. 1 mounted on tennis shoe in a "tied" configuration.
Figure 3B:
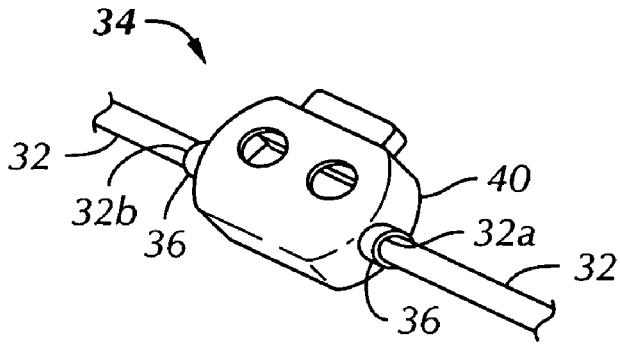
FIG. 3B is a perspective view of a clasp for the apparatus for illuminating shoes of FIG. 1.
Figure 3C:
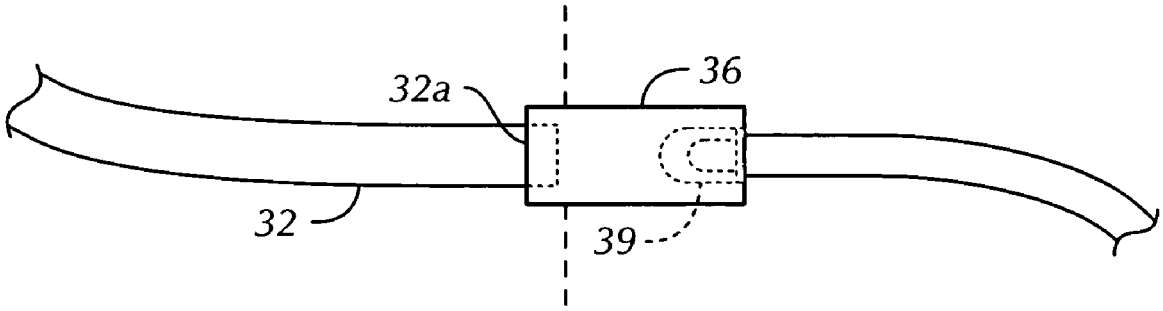
FIG. 3C is an enlarged view of a fiber optic cable and a fiber optic connector for the apparatus for illuminating shoes of FIG. 1.

Certain terminology is used in the following description for convenience only and should not be construed as limiting. The word "a" as used in the claims and in the corresponding portions of the Specification, means "one or more than one." In the drawings, the same reference numerals are employed for designating the same elements throughout the figures.

Referring to the drawings in detail, FIGS. 1, 1A-1B, 2, 3A-3C, and 4-5 show an apparatus or a lighting system 30 for illuminating shoes 90 and shoe accessories 92*a*-92*f* in accordance with a first preferred embodiment of the present invention.

Figure 4:
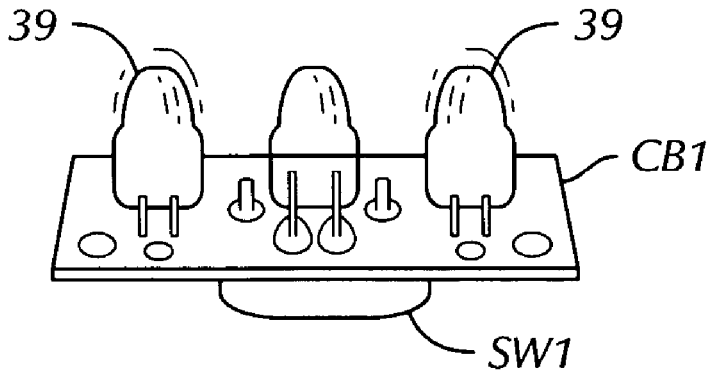
FIG. 4 is a perspective view of a first circuit board having a control circuit for use with the preferred embodiments of the present invention.
Figure 5:
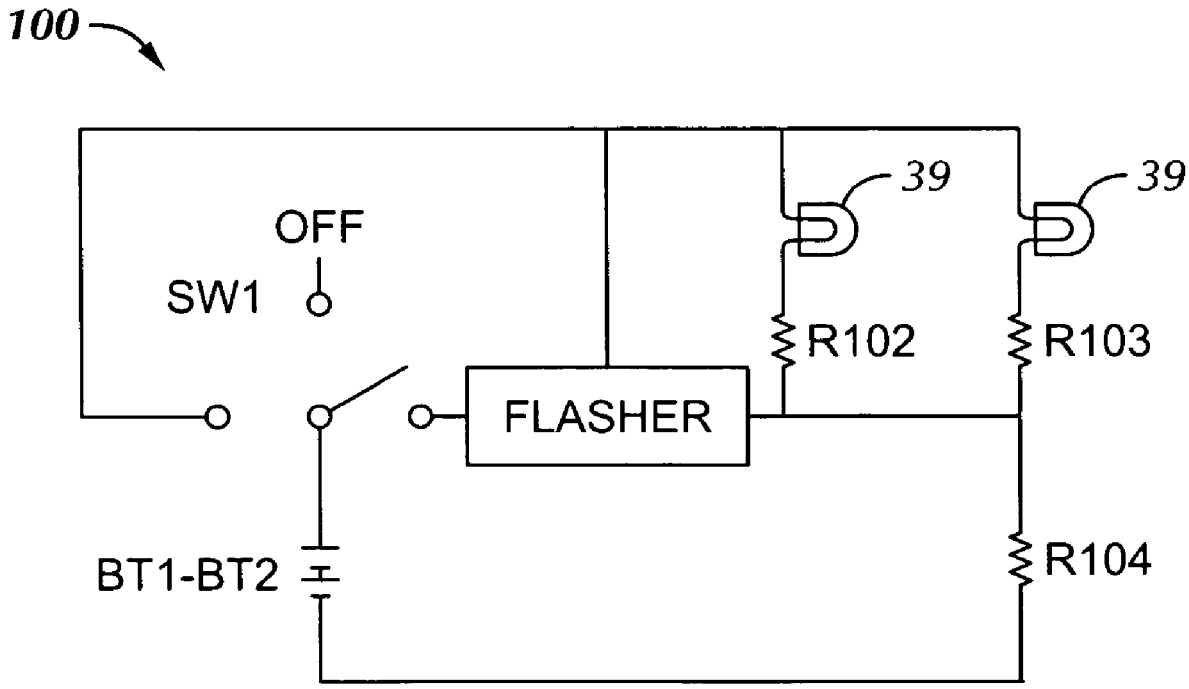
FIG. 5 is a simplified circuit schematic of a first control circuit for use with the preferred embodiments of the present invention.

FIG. 1 shows the lighting system 30 for illuminating shoes 90 installed on a typical, generic tennis sneaker or shoe 90 as a replacement for shoelaces 92*e*. The lighting system 30 includes a fiber optic cable 32, a clasp 34, and a light source or light emitting diode (LED) 39 (FIGS. 4-5). The lighting system 30 may be employed as shoelaces 92*e* or alternatively may be installed as a shoe accessory 92*a*-92*d* such as mounting the fiber optic cable 32 along the bead or upper edge 92*a* of a shoe's sole 92*c*, within the sole 92*c*, as replacement stitching or beading 92*b* or around a rim 92*d* of the shoe 90. The lighting system 30 may be used not only to illuminate the shoe 90, but also to secure the shoe 90 as shoelaces 92*e*.

The clasp 34 includes a housing 40 (FIG. 3B), a retention mechanism 38, fiber optic connectors 36 and cable receiving holes 40*a*, 40*b*. Preferably, the retention mechanism 38 is a spring-loaded push button 38 which is biased to compress the fiber optic cable 32 when not pressed by a user. The housing 40 in addition to functioning as a clamp for the fiber optic cable 32, houses a control circuit 100 disposed on a first circuit board CB1 (FIGS. 4-5). By threading the fiber optic cable 32 through the cable through-holes 40*a*, 40*b* and then connecting first and second coupling points or ends 32*a*, 32*b* of the fiber optic cable 32 to the connectors 36, the LEDs 39 mounted on the circuit board CB1 are able to illuminate the fiber optic cable 32. The spring-loaded push button 38 is depressed to release spring-loaded pressure on the fiber optic cable 32 looped through the cable through-holes 40*a*, 40*b*. The clasp 34 may also be implemented by using other retention devices instead of the spring-loaded push button 38, including locks, clips, clamps, vices, ties, pull-ties, leashes, tethers, yokes and the like, as would be obvious to one skilled in the art.

Preferably, the fiber optic cable 32 is a side glow polymeric fiber optic cable with a clear jacket 35. One side glow fiber optic cable is commercially available from Fiber Optic Products, Inc., Clearlake Oaks, Calif., such as the model SGS3, SGS7, SGS10 or SGS14 stranded side glow cable fiber optic cables. Side glow-type fiber optic cable 32 has a single large diameter solid optical gel core 33 made from optically pure cast acrylic monomers, including a core 33 of transparent polymethylmethacrylate (PMMA) material having a high refractive index, commonly referred to as simply MMA, or a bundle of such solid optical gel cores 33 in a clear jacket 35 (i.e., a stranded fiber optic cable). A clear, or more preferably a crystal clear, Teflon™ cladding or jacketing 35 provides a high intensity brightness along the length of the fiber optic cable 32 (Teflon is a registered trademark of E.I. Du Pont DeNemours and Company, Wilmington, Del.). Teflon cladding 35 is generally chemically resistant and generally resistant to solvents. The cladding or jacketing 35 can be formed of other materials. The fiber optic cable 32 can allow light to be conducted or transmitted from the light source(s) 39 over reasonably long distances. Light can be conducted or transmitted over the entire length of the solid core 33 of the fiber optic cable 32 without danger of electrical shock or significant heat generation.

The bend radius of the fiber optic cable 32 is less than about six times the diameter of the fiber optic cable 32. However, fiber optic cables 32 having other bend radii may be utilized. Preferably, the fiber optic cable 32 has a spectral range between about 370 nanometers (nm) to 690 nm (i.e., roughly, the visible wavelength range), an acceptance angle of about 45 degrees, a numerical aperture of about 0.65, a glass transition temperature of about 53.8 degrees Celsius and an attenuation of less than about 1.6% per foot (5.3% per meter). Of course, fiber optic cables 32 having other characteristics may be utilized to conduct or transmit light waves from a light source 39 without departing from the present invention. Further, any optically conductive material 32, 33 made of fiberglass, polymeric materials, and the like, may be utilized to conduct light in connection with the preferred embodiments of the present invention as would be known to one skilled in the art.

As shown herein, the light source 39 is a light emitting diode (LED). The LEDs 39 are preferably a high-brightness micro-candela variety (i.e., epoxy encapsulated dome-lens-type LEDs). The LEDs 39 can be about 1-5 millimeters (mm), but any size LED 39 can be utilized. The LEDs 39 can be provided in any variety of colors including clear, white, blue, violet, red, yellow, green, orange, and the like thereby providing a wide array of different combinations of illuminated shoes 90 as demonstrated in FIGS. 6-14. Other LEDs and/or light sources 39 may be utilized such as halogen lamps, incandescent lamps, and other solid-state and other excited-gas light emitting devices without departing from the present invention. In some embodiments, the light source(s) 39 is/are removable to permit interchangeable selectivity of the color of the illuminating light. Alternatively, colored lenses or filters (not shown) can be placed over the light sources 39 to permit interchangeable selectivity of the color of the illuminating light.

As shown in FIGS. 1, 1A-1B and 2, the fiber optic cable 32 can be threaded through the eyelets 91 of the shoe 90 in the same fashion as a shoelace 92*e*. The fiber optic cable 32 is then fed through the cable through-holes 40*a*, 40*b* of the clasp 34 and each coupling point 32*a*, 32*b* of the fiber optic cable 32 is looped over and plugged into respective fiber optic connectors 36 thereby providing the appearance of a bow-tied shoelace 92*e*. By depressing the spring-loaded push button 38 the fiber optic cable 32 can be pulled tight to help retain the shoe 90 on the foot of a user.

FIG. 4 shows that the first control circuit board CB1 includes the LEDs 39, a first switch SW1, and first control circuit 100 (FIG. 5). FIG. 5 shows a basic control schematic for the first control circuit 100 which can be utilized with the embodiments of the present invention. The first control circuit 100 includes the 3-position, sliding or toggle switch SW1 which has an always on position, an off position, and a flasher position. The first control circuit 100 also includes a power source such as the one or more batteries BT1-BT2. Various biasing components such as resistors R102-R104 may be utilized as necessary. When the switch SW1 is in the always on position, the LEDs 39 are continuously connected to the power source or batteries BT1-BT2. When the switch SW1 is in the flasher position, the flasher portion of the first control circuit 100 intermittently applies power from the batteries BT1-BT2 to the LEDs 39 to create a flashing effect, which also extends the life of the batteries BT1-BT2 by reducing the overall on-time of the load on the control circuit 100. The flashing can be periodic, alternating, intermittent, random and the like. Preferably, the batteries BT1-BT2 are a small size such as a button battery or hearing aid size battery, such as a number ten hearing aid battery. Of course, other power sources, such as solar or piezoelectric power sources, and/or other batteries BT1-BT2 may be utilized without departing from the present invention.

Additionally, the first control circuit 100 may be implemented with more complex circuitry such as utilizing timer integrated circuits, logic gates, transistors, amplifiers, programmable logic arrays, application specific integrated circuits, microcontrollers and the like, in order to create a variety of different effects such as brightness control, color sequencing, flash-speed, flash-pattern and the like.

The switch SW1 may also be activated by a sensor (not shown) such as motion sensor, temperature sensor, proximity sensor, pressure sensor and the like, in order to prevent the need for the user to have to activate and deactivate the switch SW1 manually. The first control circuit 100, once activated, may remain on for a predetermined period of time before deactivating by an automatic timer (not shown) or may deactivate after the sensor loses signal or a combination of time and sensor activity for convenience and to preserve the life of the batteries BT1-BT2.

Figure 31:
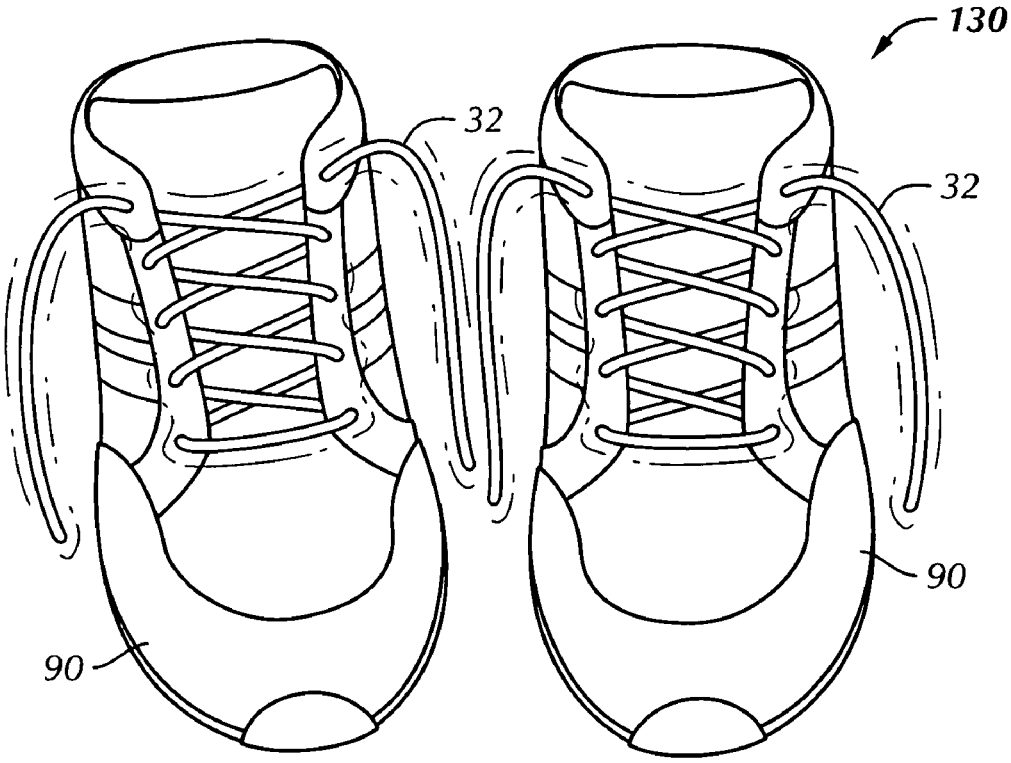
FIG. 31 is a perspective view of the apparatus for illuminating shoes with the clasp of FIGS. 20A-20C in an illuminated state mounted on a tennis shoe in an "untied" configuration.
Figure 32:
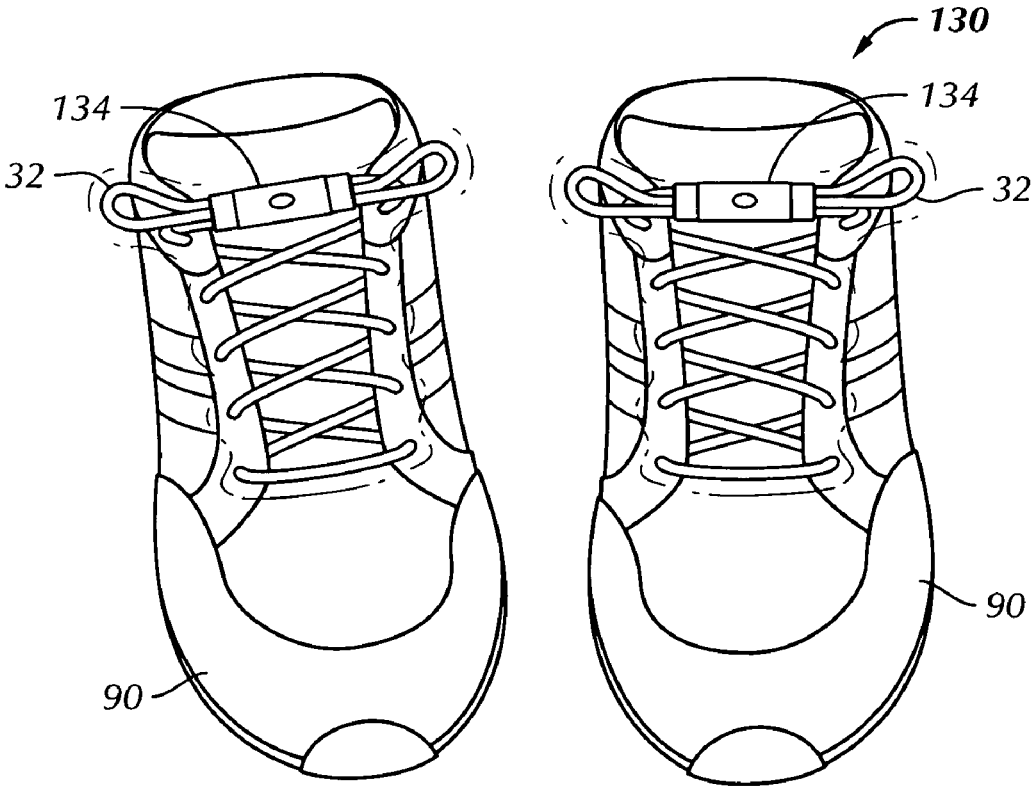
FIG. 32 is a perspective view of the apparatus for illuminating shoes with the clasp of FIGS. 20A-20C mounted on tennis shoe in a "tied" configuration.

FIG. 31 shows an apparatus 130 for illuminating shoes 90 in accordance with a second preferred embodiment of the present invention. The apparatus 130 includes a clasp 134 (FIGS. 20A-20C and 21-24). FIG. 31 shows the apparatus 130 for illuminating shoes 90 in an illuminated state mounted on a tennis shoe 90 in an "untied" configuration, and FIG. 32 shows the apparatus for illuminating shoes with the clasp 134 mounted on tennis shoe in a "tied" configuration.

FIGS. 20A-20C and 21-24 are renderings of the clasp 134 for the apparatus 130 in accordance with the second preferred embodiment. As best shown in exploded view FIGS. 26-27, the clasp 134 includes a housing 140, a mating lid 149, a first end cap 141, a second end cap 142, fiber optic connectors 136 and cable receiving clips 140*a*, 140*b*. The clasp 134 also includes a second circuit board CB2 and batteries BT1-BT3. Each of the end caps 141, 142 has a cable through-hole 141*a*, 142*a*, respectively, for receiving fiber optic cable 32. The housing 140 and mating lid 149 are generally cylindrically-shaped and together encase the circuit board CB2 and the batteries BT1-BT3.

The mating lid 149 has a nib 155 at a first end 149*a* and a threaded half fitting 157 at a second end 149*b*. Likewise, the housing 140 has a threaded full fitting 145 at a first end 140*c* and a threaded half fitting 147 at a second end 140*d*. When the mating lid 149 is placed over the housing 140 such that the nib 155 is mated with an inside of the threaded full fitting 145, the threaded half fitting 157 of the mating lid 149 and the threaded half fitting 147 of the housing 140, together, form a threaded full fitting 147, 157 which can be capped by end-cap 142. The full fitting 145 and half fittings 147, 157 are shown having a male thread such as a pipe thread, and the end caps 141, 142 are shown having a female thread. But, other attachment mechanisms may be used to place the first and second end caps 141, 142 over the full fitting 145 and half fittings 147, 157 such as detents, snap rings, frictional fittings and the like.

Figure 24:
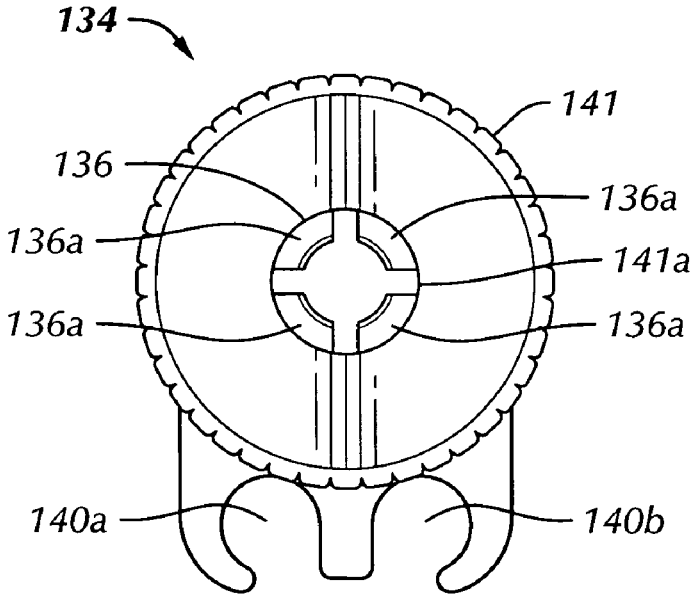
FIG. 24 is a first end elevational view of the clasp of FIGS. 20A-20C.
Figure 25:
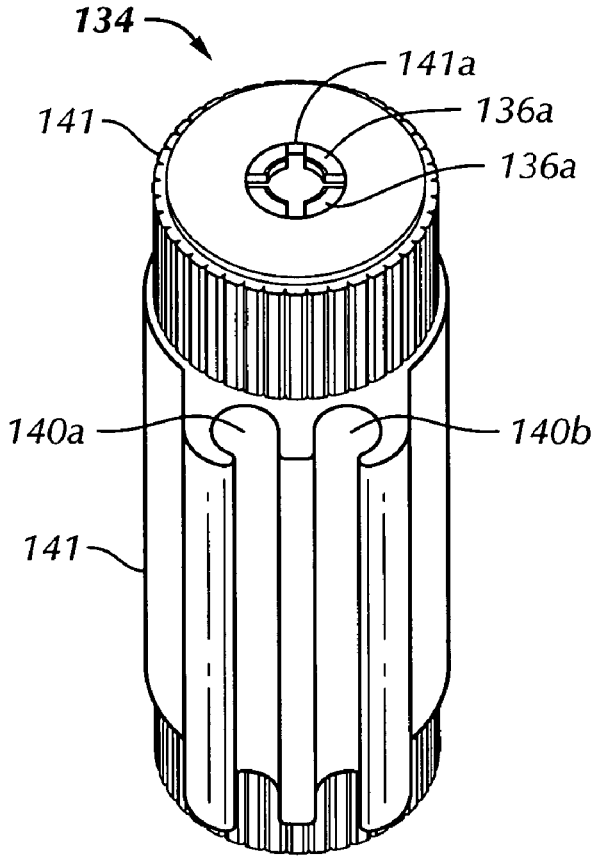
FIG. 25 is a first end perspective view of the clasp of FIGS. 20A-20C.

The fiber optic connectors 136 each rest in the full fitting 145 and the overlapping half fittings 147, 157, respectively. The end caps 141, 142 are then secured to the full fitting 145 and the overlapping half fittings 147, 157, respectively, over the fiber optic connectors 136. The fiber optic connectors 136 each have a plurality of fingers 136*a* (FIG. 24). The plurality of fingers 136*a* are slightly sloped (a frusta-conical shape) so as to be received by each the cable through-holes 141*a*, 142*a*. As the end caps 141, 142 are secured onto the full fitting 145 and the overlapping half fittings 147, 157, the plurality of fingers 136*a* are biased together.

Figure 29:
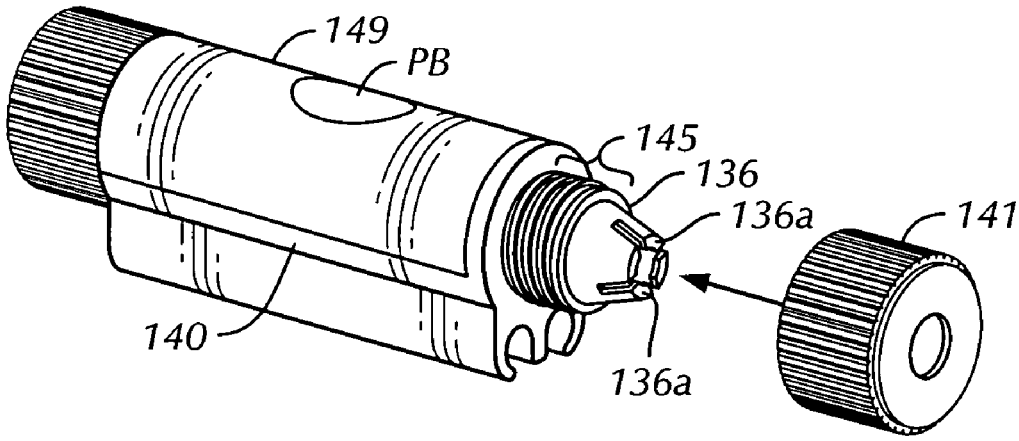
FIG. 29 is a perspective view of the clasp of FIGS. 20A-20C with an end-cap being installed.
Figure 30:
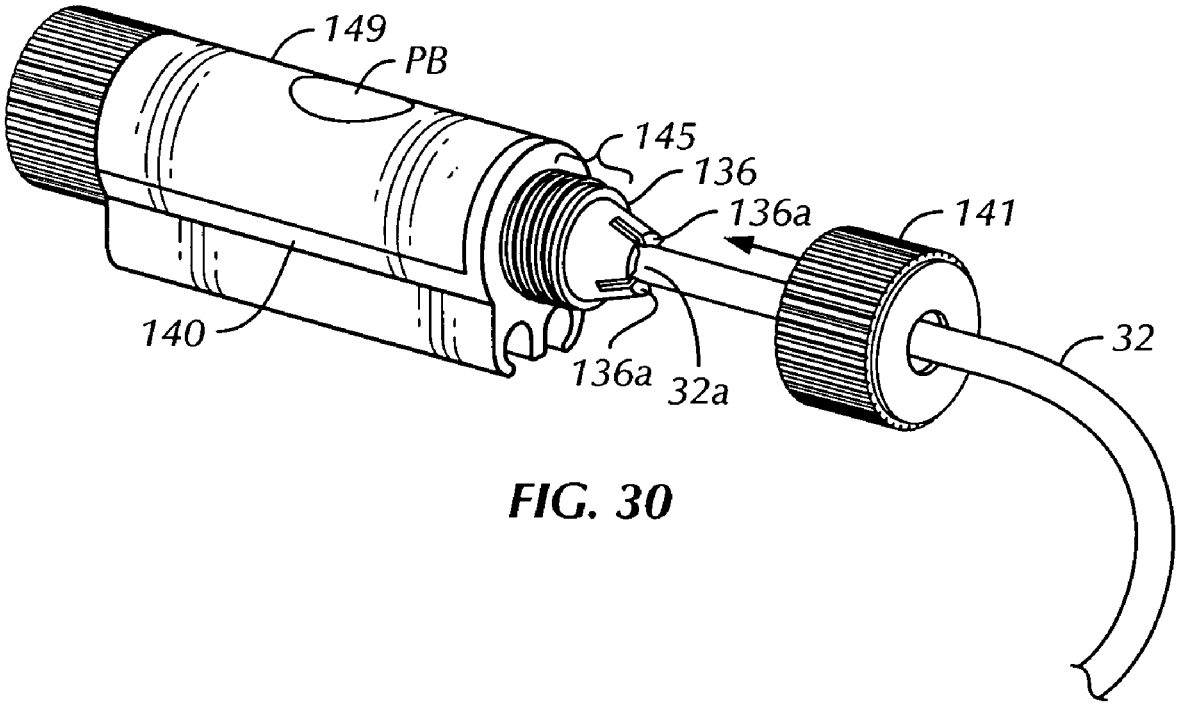
FIG. 30 is a perspective view of the clasp of FIGS. 20A-20C with a fiber optic cable being installed through an end-cap.

As shown in FIGS. 29-30, the end cap 141 is removed or simply loosened from the full fitting 157. The first end 32*a* of the fiber optic cable 32 is inserted through the cable through-hole 141*a* in the end cap 141 and between the plurality of fingers 136*a* of the fiber optic connector 136. The end cap 141 is then secured or tightened to the full fitting 157 such that the plurality of fingers 136*a* are biased together thereby securely grasping the fiber optic cable 32 as the end cap 141 is more securely tightened. A similar operation is performed using the second end 32*b* of the fiber optic cable 32. After removing or loosening the second end cap 142, the second end 32*b* of the fiber optic cable 32 is inserted through the cable through-hole 142*a* of the second end cap 142 and between the plurality of fingers 136*a* of the fiber optic connector 136. The second end cap 142 is then secured or tightened to the overlapping half fittings 147, 157 such that the plurality of fingers 136*a* are biased together thereby securely grasping the fiber optic cable 32 as the end cap 142 is more securely tightened. Thus, the end caps 141, 142 and fiber optic connectors 136 form a compression fitting.

The fiber optic connectors 136 may optionally include a reducer fitting or bushing (not shown clearly) as an additional means of retaining the first and second ends 32*a*, 32*b* of the fiber optic cable 32.

Figure 20A:
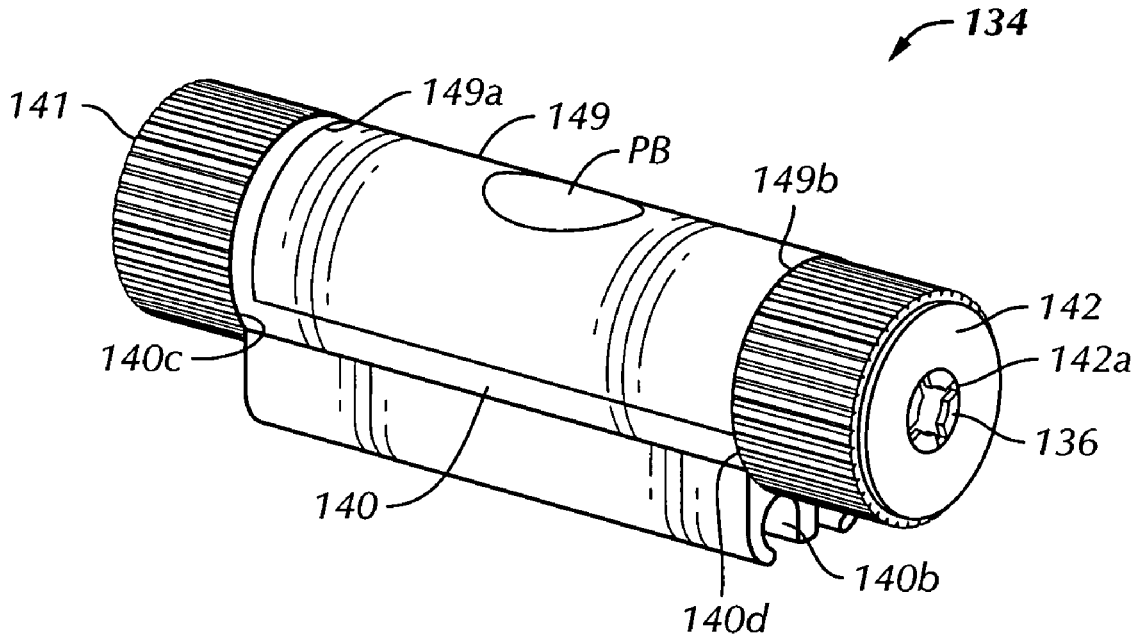
FIGS. 20A-20C are perspective views of a clasp for an apparatus for illuminating shoes in accordance with a second preferred embodiment of the present invention.
Figure 20B:
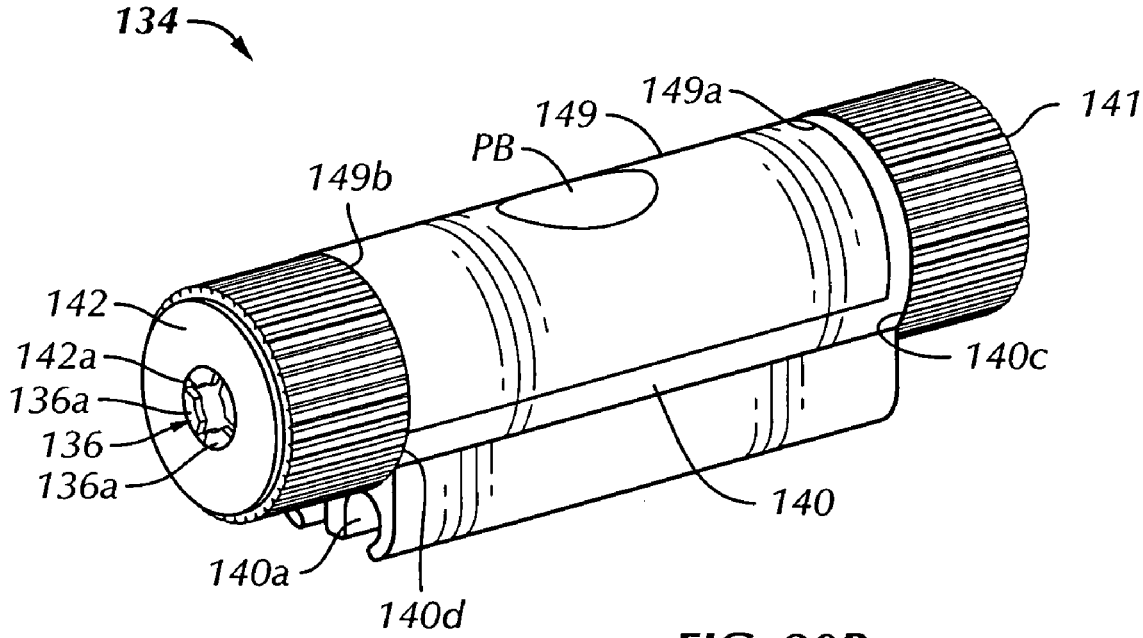
Figure 20C:
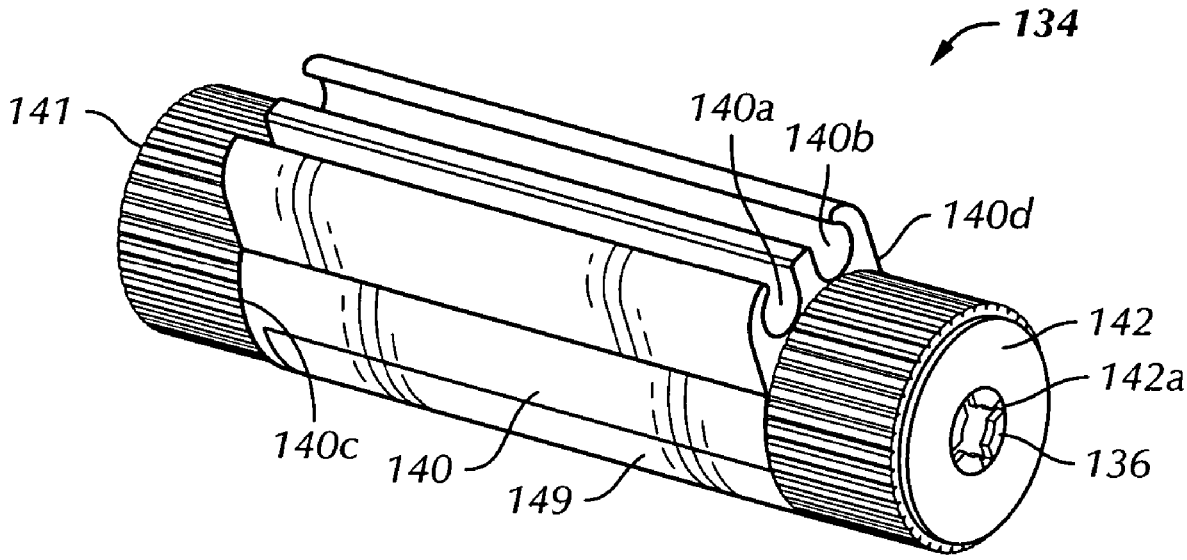
Figure 21:
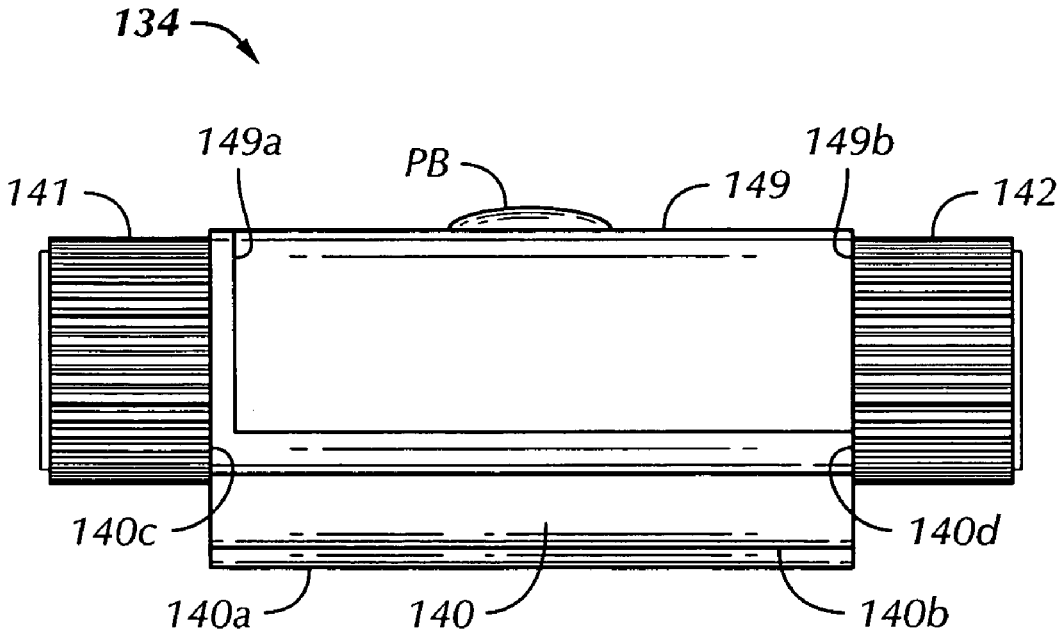
FIG. 21 is a side elevational view of the clasp of FIGS. 20A-20C.
Figure 22:
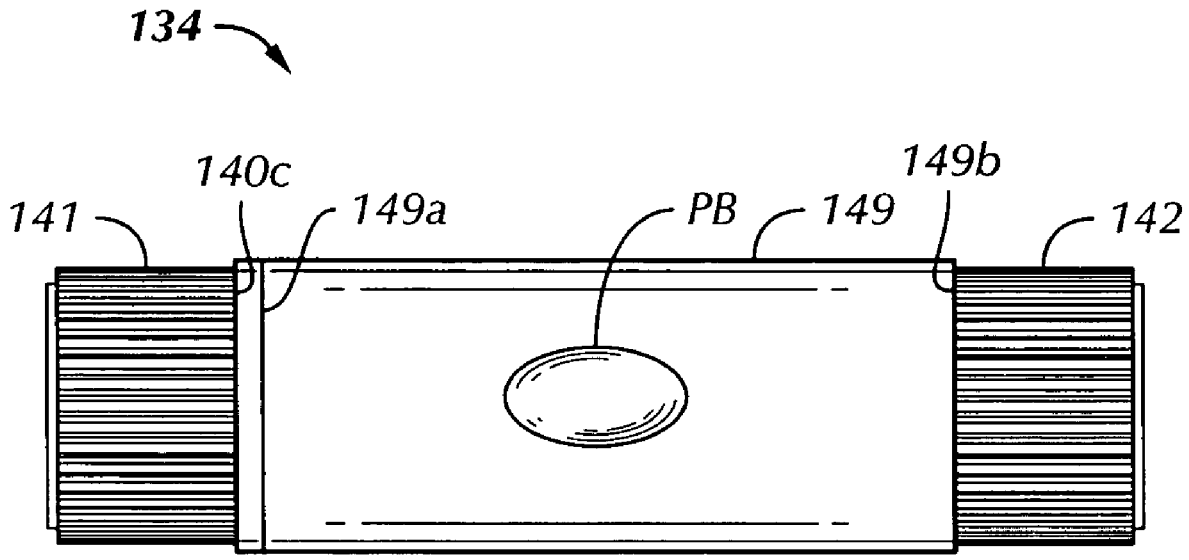
FIG. 22 is a top plan view of the clasp of FIGS. 20A-20C.
Figure 23:
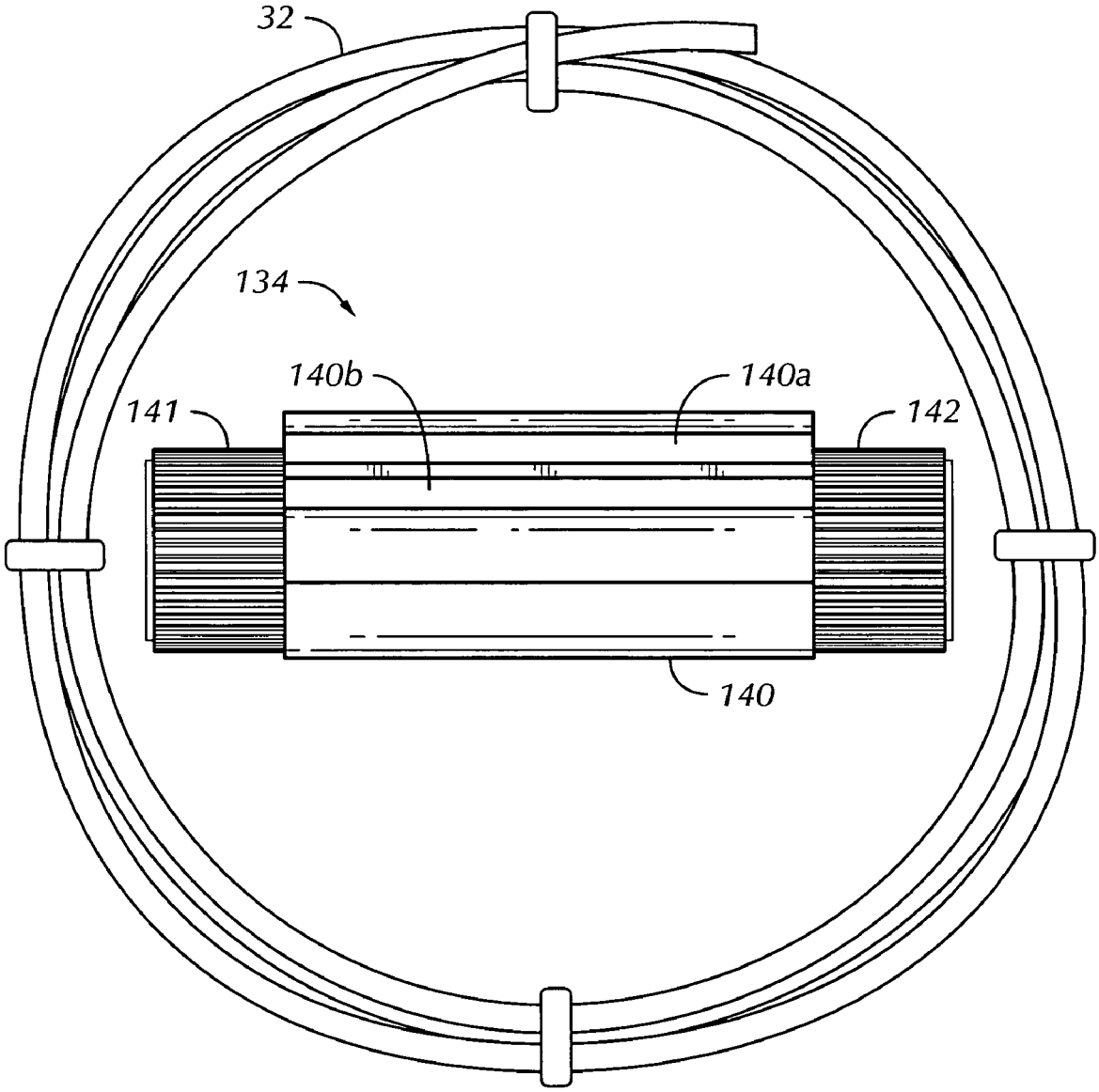
FIG. 23 is a bottom plan view of the clasp of FIGS. 20A-20C with a fiber optic cable.

The cable receiving clips 140*a*, 140*b* are side by side on the bottom of the housing 140 (FIGS. 20C and 24). The cable receiving clips 140*a*, 140*b* are partially cylindrically-shaped (i.e., having a C-shaped cross section as shown in FIG. 24). The fiber optic cable 32 can be pressed into the receiving clips 140*a*, 140*b* or threaded therethrough. The receiving clips 140*a*, 140*b* are arranged to permit the fiber optic cable 32 to be secured in various configurations such as a faux bow-tie (FIG. 31).

Figure 33:
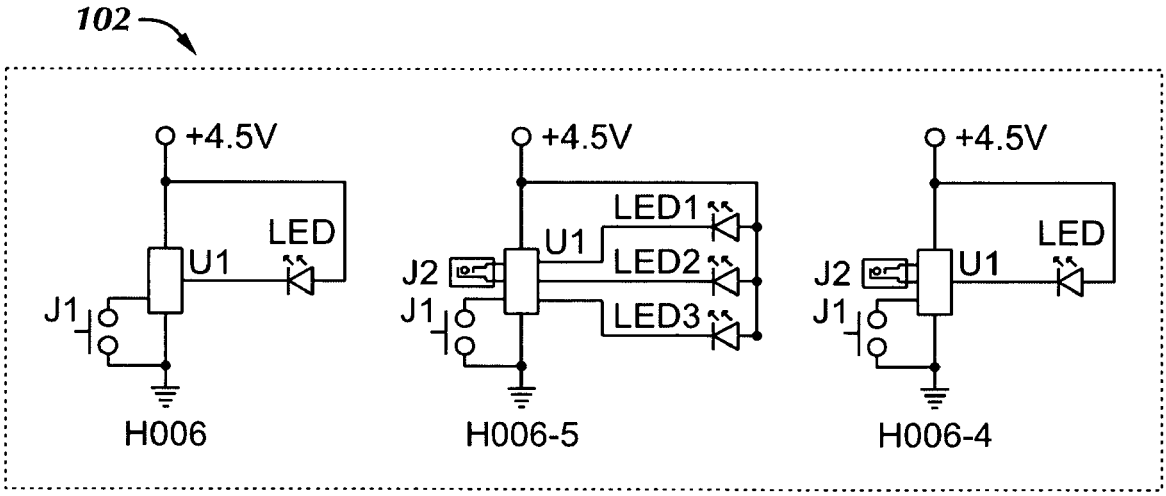
FIG. 33 is a simplified circuit schematic of a second control circuit for use with the preferred embodiments of the present invention.
Figure 26:
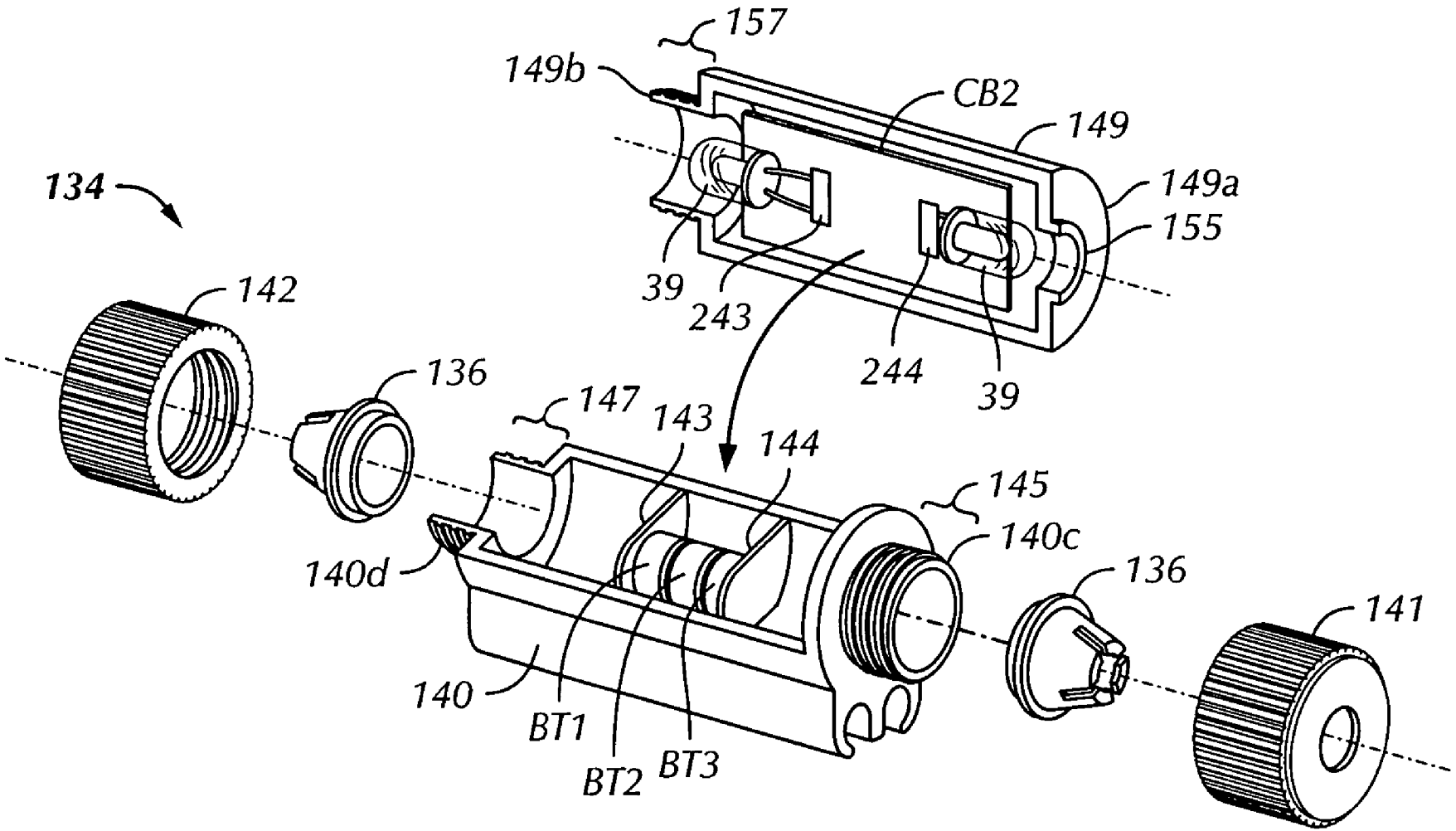
FIG. 26 is a partially exploded view of the clasp of FIGS. 20A-20C.
Figure 27:
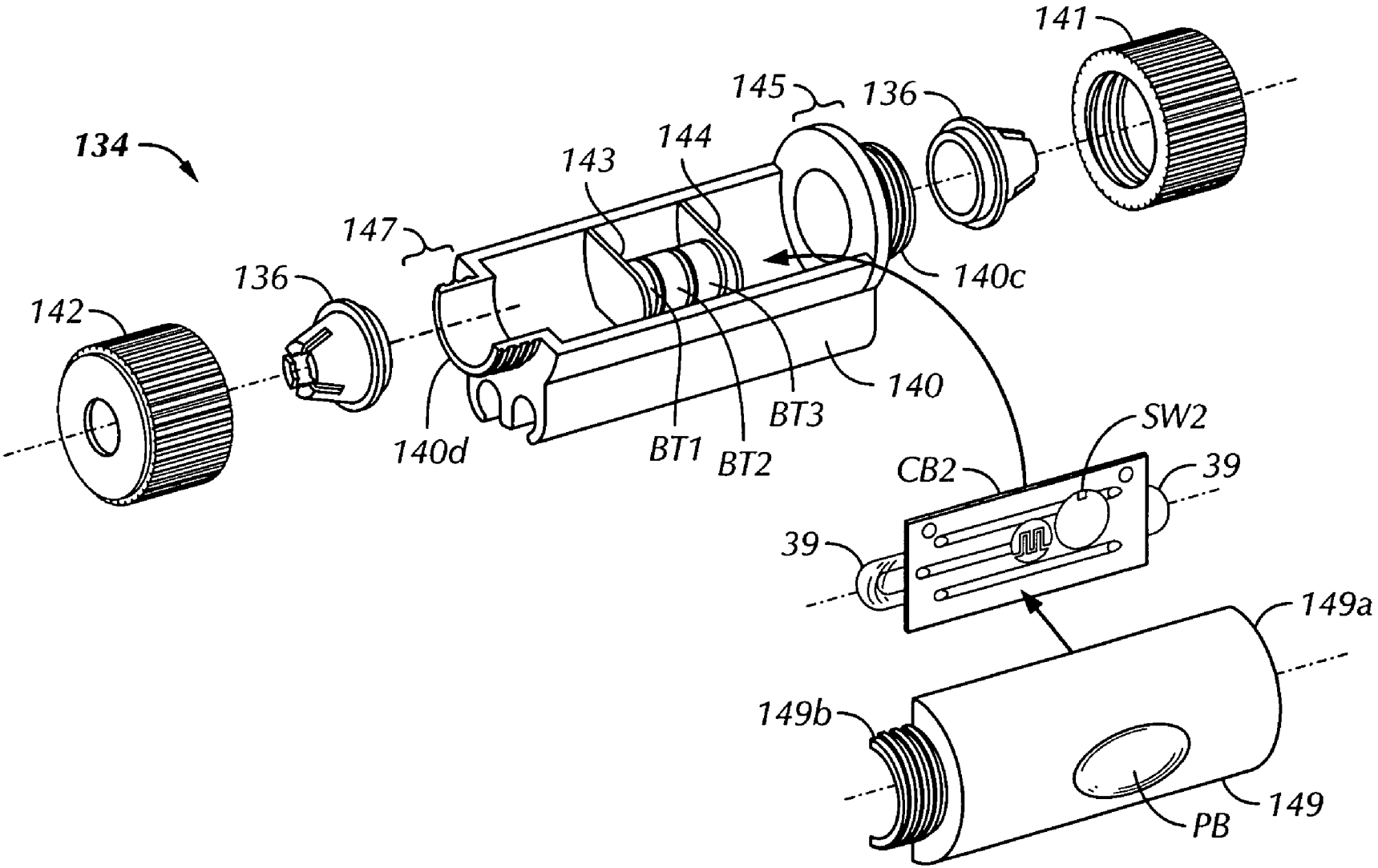
FIG. 27 is a partially exploded view of the clasp of FIGS. 20A-20C.
Figure 28:
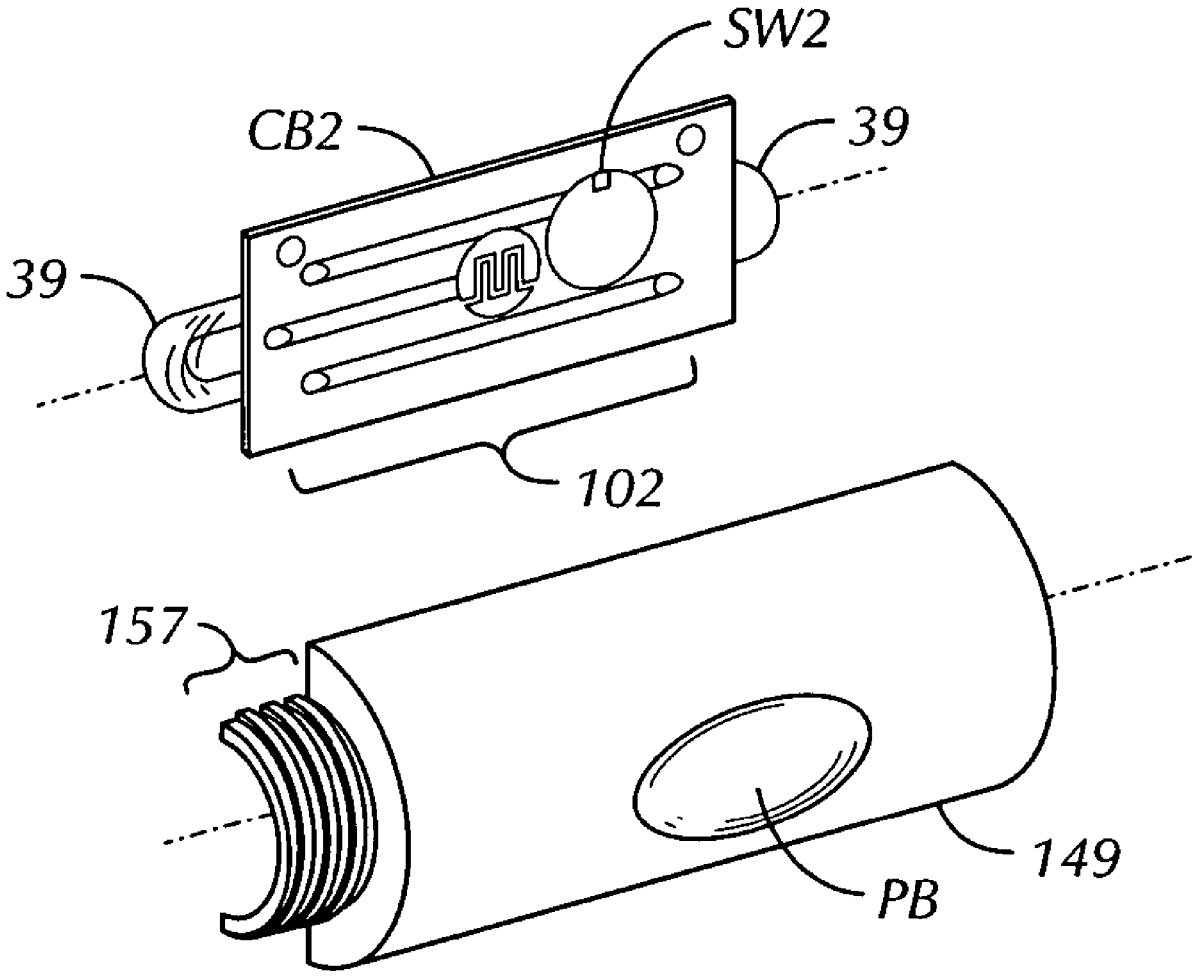
FIG. 28 is a top view of a second circuit board and a mating lid for the clasp of FIGS. 20A-20C.

The housing 140 and mating lid 149 houses the second circuit board CB2 (FIGS. 26-28). More particularly, the second circuit board CB2 is receiving on mounting posts or standoffs inside the mating lid 149. The second circuit board CB2 includes a second control circuit 102 (FIG. 33) with the LEDs 39. The LEDs 39 are mounted in an orientation parallel to the circuit board CB2 so as to be directed toward the first and second ends 140*c*, 140*d* of the housing 140. The batteries BT1-BT3 are accessed by removing one or both end caps 141, 142 to release the mating lid 149 from the housing 140. Contacts 143 and 144 are disposed within the housing 140, and the batteries BT1-BT3 are arranged in series between the contacts 143, 144. When the mating lid 149 is secured to the housing 140, contact pads 243, 244 on the second circuit board CB2 engage the contacts 143, 144 to apply power to the second control circuit 102. Other means of connecting the batteries BT1-BT3 to the second control circuit board CB2 may also be utilized such as wires, springs and the like.

The second control circuit 102 has similar circuitry to the first control circuit 100, except the second circuit board CB2 has a touch-activated switch SW2 which is actuated by a bubble-membrane push button PB disposed on the mating lid 149. The second control circuit 102 is activated into an "always-on" state (i.e., LEDs 39 continuously energized) by pressing the push button PB once, into a "slow-flash" state (i.e., LEDs 39 energized and deenergized at a slow pace) by pressing the push button PB as second time, into a "fast-flash" state (i.e., LEDs 39 energized and deenergized at a quicker pace than slow-flash) by pressing the push button PB a third time and is returned to an off state by pressing the push button PB a fourth time. The second control circuit 102 could include other states such as alternating flashing of the LEDs 39, random or intermittent flashing of the LEDs 39, automatic turn-on or automatic turn-off and the like. The second control circuit 102 may also be configured to respond to an automatic shutoff timer and/or sensor as well, as described above with respect to the first control circuit 100.

By threading the fiber optic cable 32 through the receiving clips 140*a*, 140*b* and then inserting first and second ends 32*a*, 32*b* of the fiber optic cable 32 through the cable through-holes 141*a*, 142*a* and the connectors 136, the LEDs 39 mounted on the circuit board CB2 can illuminate the fiber optic cable 32, similar to the first preferred embodiment described above. The fiber optic cable 32 does not need to directly touch the LEDs 39. The LEDs 39 may be optically coupled to the fiber optic cable 32 by other optically conductive intermediate materials without departing from the invention.

The second control circuit 102 may be implemented with more complex circuitry such as utilizing timer ICs, logic gates, transistors, amplifiers, PALs, ASICs, microcontrollers and the like, in order to create a variety of different effects such as brightness control, color sequencing, flash-speed, flash-pattern and the like. Further, the second control circuit board CB2 may also be utilized in the first preferred embodiment and the first control circuit board CB1 may be utilized in the second preferred embodiment without departing from the invention.

Figure 6:
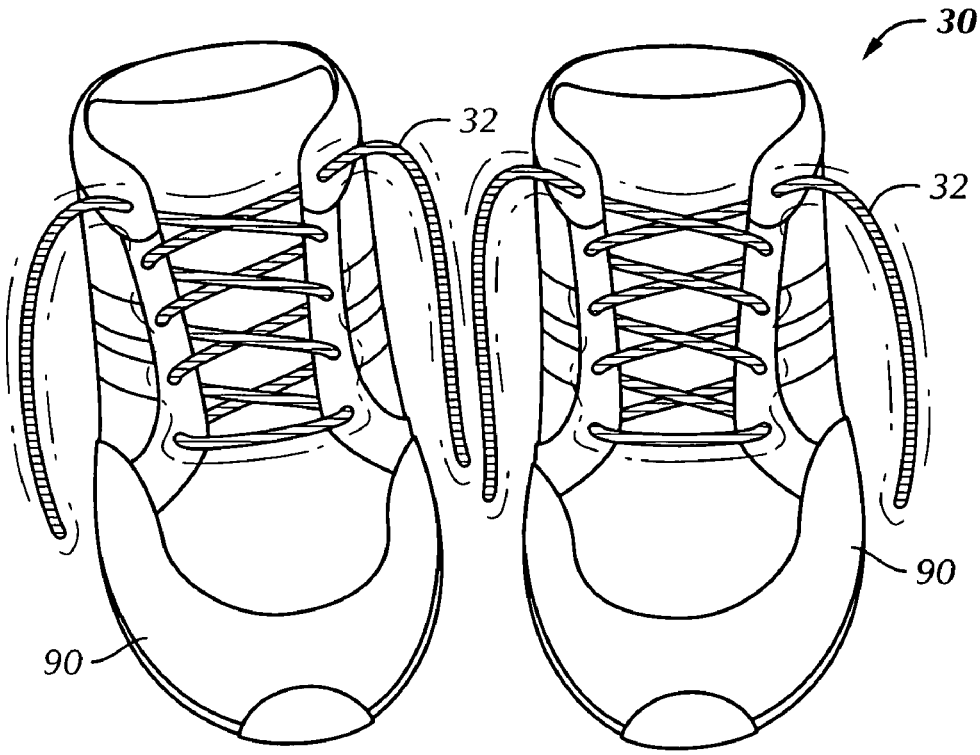
FIGS. 6-16 are perspective views of alternate embodiments of apparatuses for illuminating shoes depicting a variety of colored light combinations.

A unique aspect of the present invention is that the clasp 34 may be configured with a variety of different colored LEDs 39. Accordingly, a user can interchange different clasps 34, 134 having different color LEDs 39 to change the visual appearance of their shoes 90 with or without changing the fiber optic cable 32. FIGS. 6-14 are perspective views of alternate embodiments of apparatuses for illuminating shoes 30, 130 depicting a variety of colored-light combinations. For example, FIG. 6 shows one shoe 90 having a clasp 34, 134 with blue LEDs 39 and another shoe 90 having a clasp 34, 134 with violet or ultraviolet LEDs 39.

Figure 7:
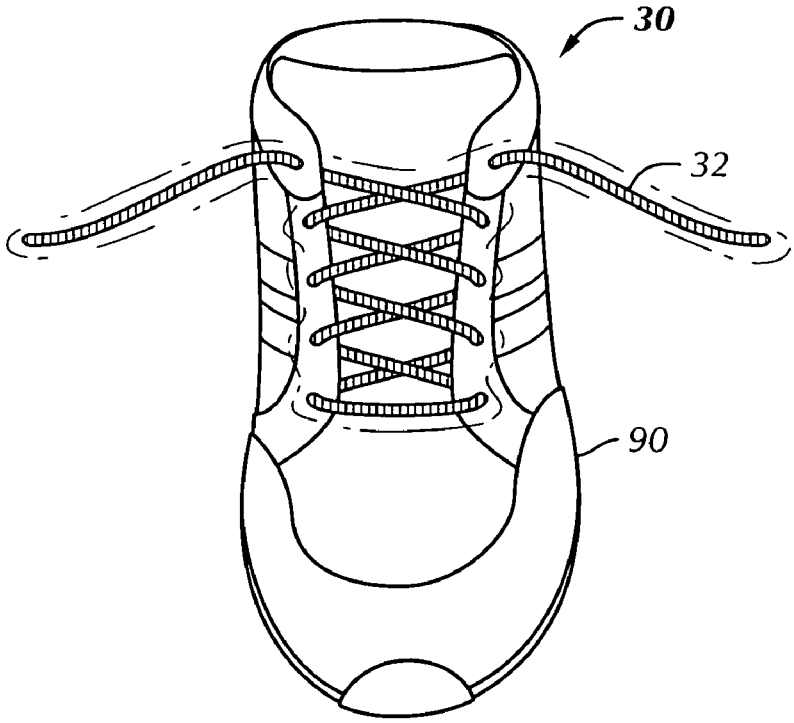
Figure 8:
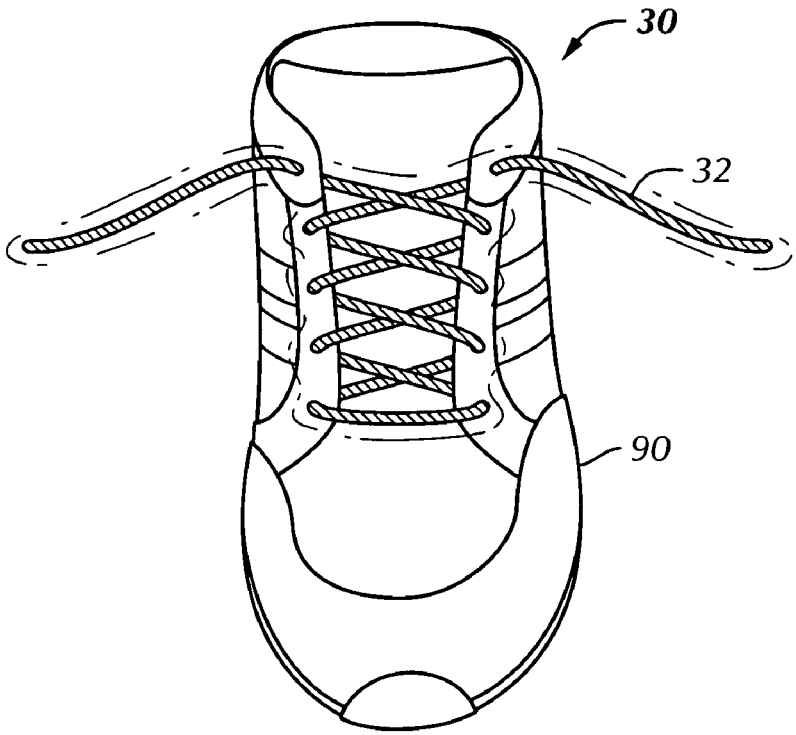
Figure 9:
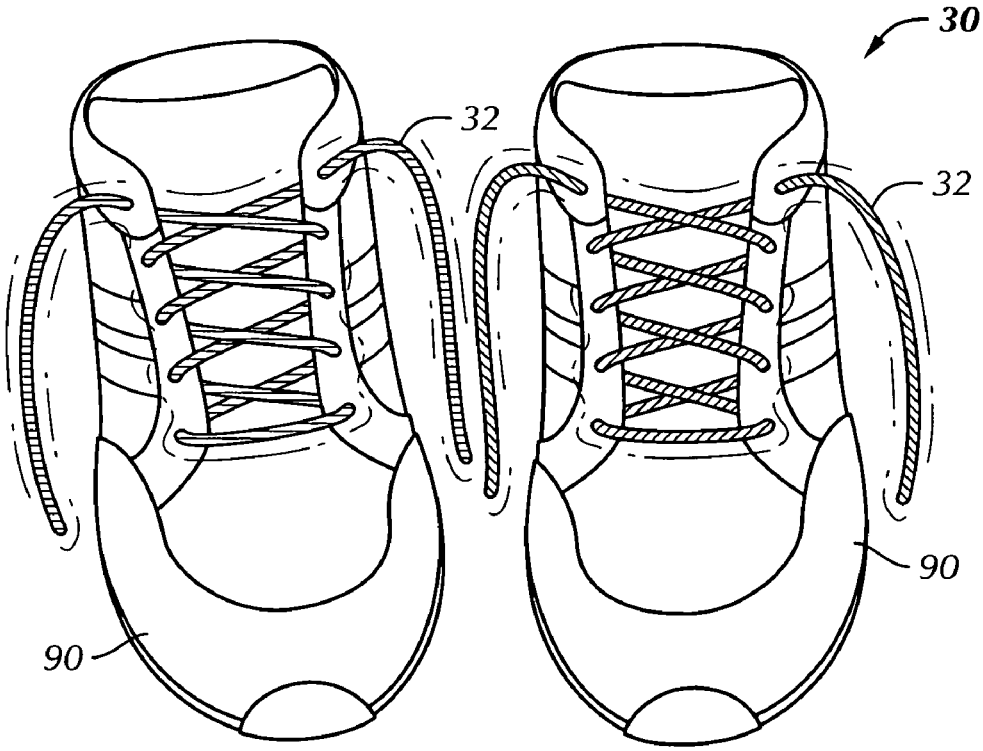
Figure 10:
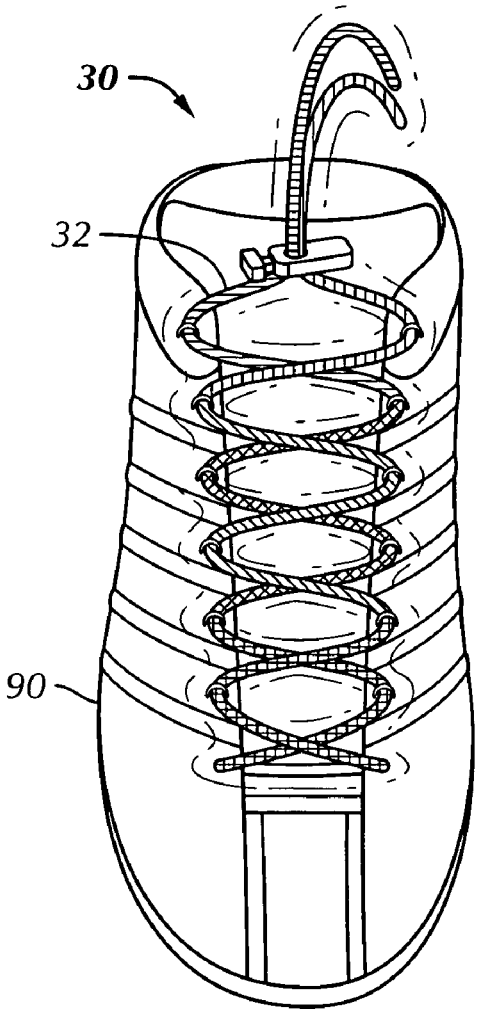
Figure 11:
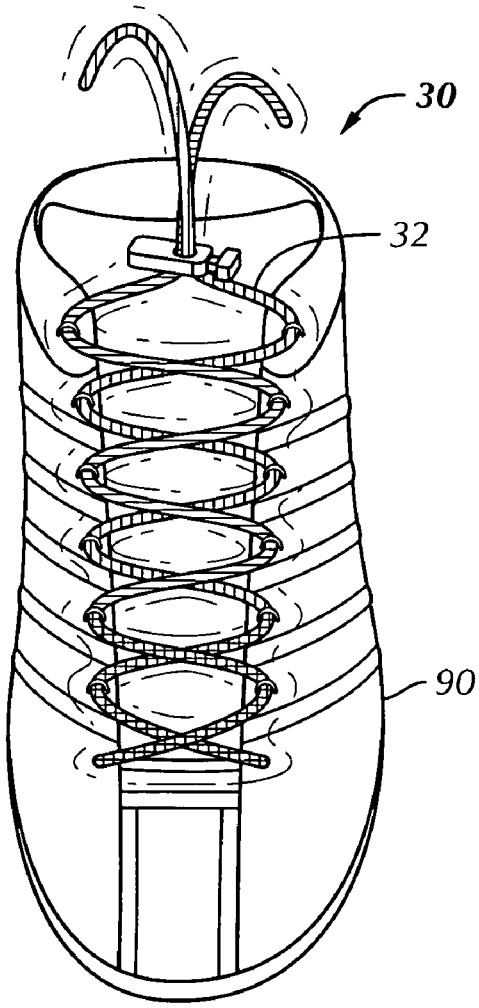
Figure 12:
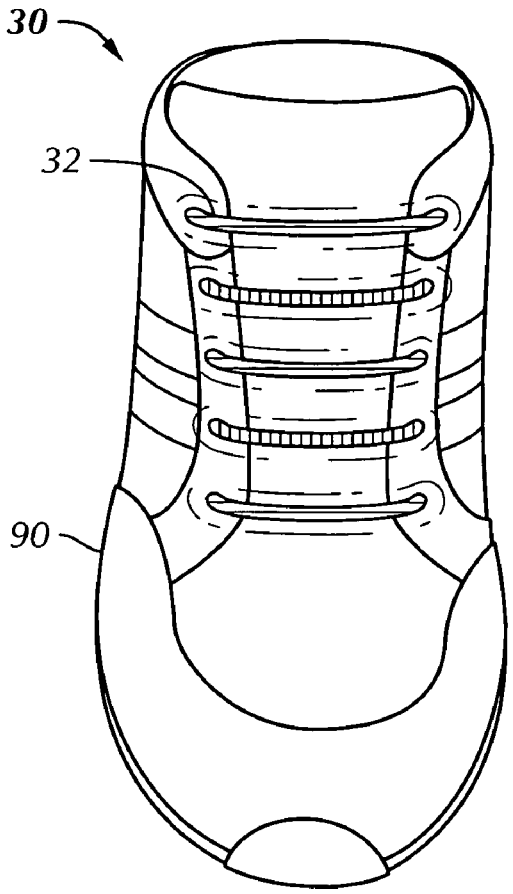
Figure 13:
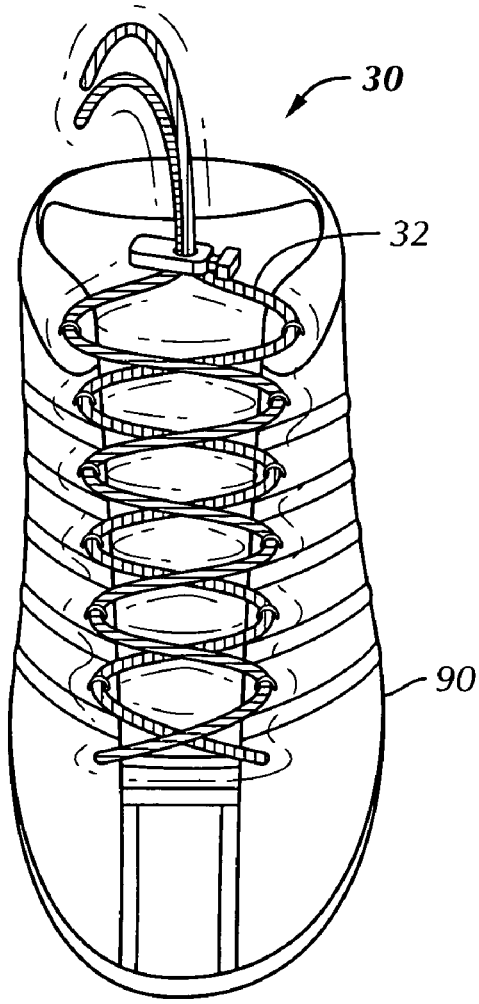
Figure 14:
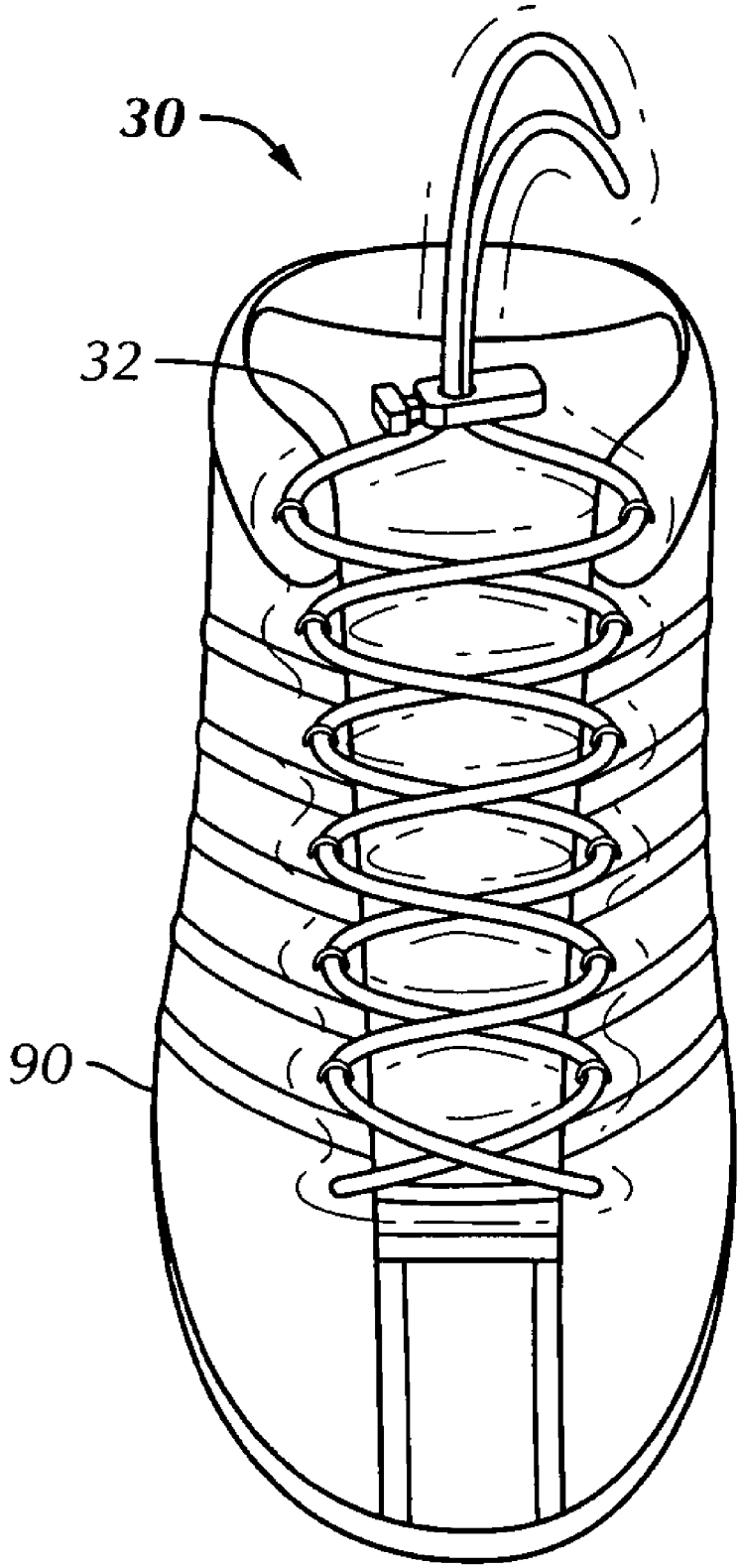

FIG. 7 shows a shoe 90 having a clasp 34, 134 with orange or red LEDs 39. FIG. 8 shows a shoe 90 having a clasp 34, 134 with green LEDs 39. FIG. 9 shows one shoe 90 having a clasp 34 with blue LEDs 39 and a second shoe 90 having a clasp with green LEDs 39. FIG. 10 shows a clasp 34 having one green LED 39 and one orange LED 39 creating another unique combination effect. FIG. 12 shows a clasp 34, 134 having one orange LED 39 and one blue LED 39. FIG. 14 shows a clasp 34, 134 having an LED array or a colorwheel (not shown clearly) that changes to make multiple colors over a time and or pattern sequence. Preferably, at least one of the clasp 34, 134 and the LED 39 is removable to permit interchangeable selectivity of the color of the illuminating light. Alternatively, colored lenses or filters (not shown) can be placed over the light sources 39 to permit interchangeable selectivity of the color of the illuminating light.

It is contemplated that the control circuit 100, 102 can be implemented with an array of LEDs 39 which strobe a sequence of colors or which has a selector switch in addition to or as part of switch SW1, SW2 for selecting a single color from a plurality of colored LEDs 39 such that the clasp 34, 134 would not have to be changed to change colors. It is further contemplated that the fiber optic connectors 36, 136 can accept different colored lens caps (not shown) in order to more easily change the colors of the light conducted or transmitted through the fiber optic cable 32. Moreover, it is contemplated that the jacket or cladding 35 of the fiber optic cable 32 can be provided in different colors or color combinations in order to change the perceived color of the light conducted or transmitted through the fiber optic cable 32.

Figure 15:
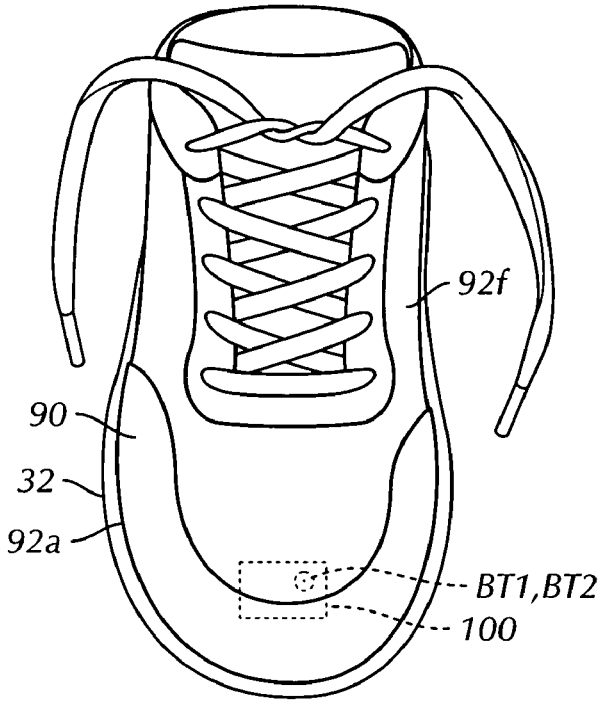
Figure 16:
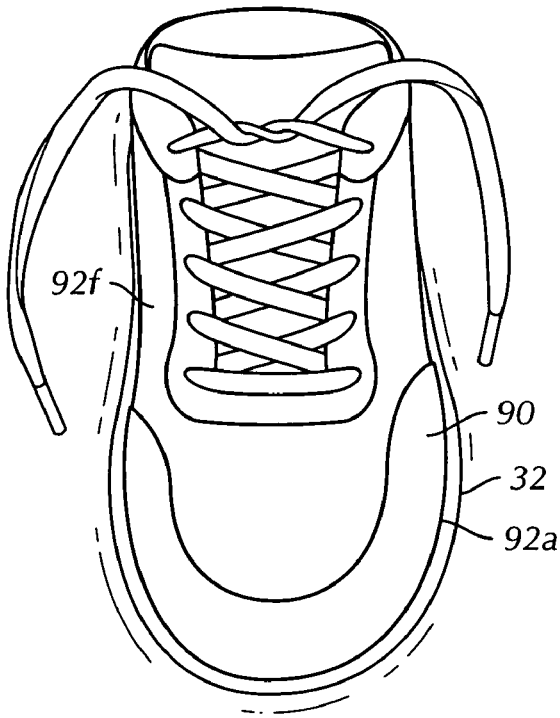
Figure 17:
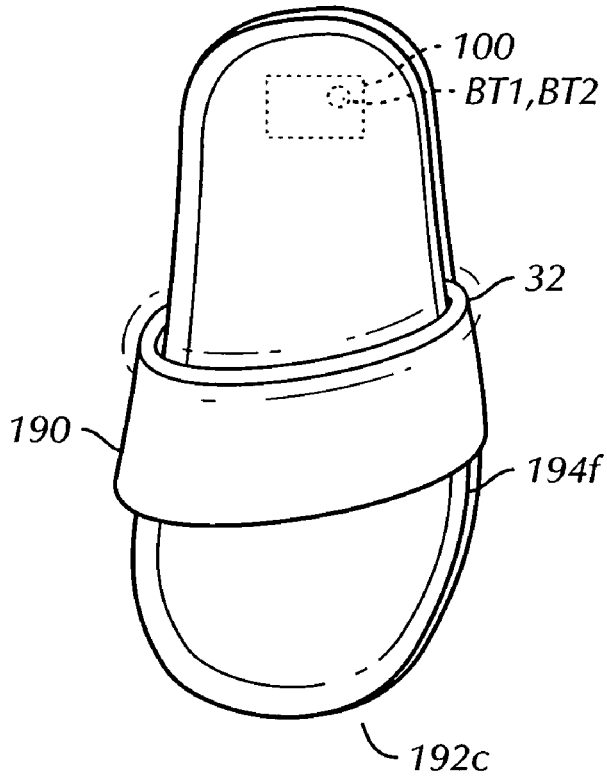
FIGS. 17-18 are perspective views of alternate embodiments of apparatuses for illuminating shoes installed in or on a sandal.
Figure 18:
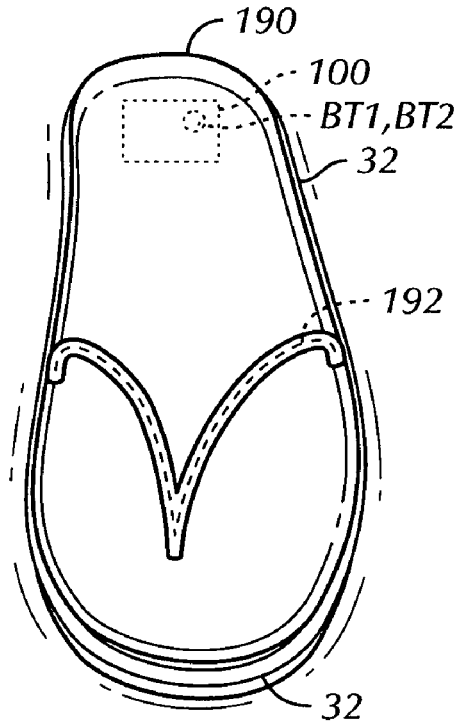

In an alternate embodiment, a pair of sandals 190 (FIGS. 17-18), strap-tie shoes (not shown) or other illuminated shoes 90 can be created using only the fiber optic cable 32 and a sole 192*c* wherein the fiber optic cable 32 functions as the thong 192*f* and/or straps and/or webbed-upper of the sandals 190, strap-tie shoes or other illuminated shoes 90. Additionally, the sole 92*c* may have fiber optic cable 32 embedded therein and/or the fiber optic cable 32 can be used as a bead around the upper edge 92*a* of the sole 92*c* (see FIGS. 15-16 for example). In the alternate embodiments, the control circuit 100, 102 may be embedded in the sole 92*c*, 192*c* or mounted to other parts of the shoes 90 or sandals 190.

In another alternate embodiment, the illuminated shoe 90 includes an optically conductive material 32, 33 partially forming at least one structural component 92*a*-92*f* of the shoe 90 and the light source 39 is optically coupled to the optically conductive material 32, 33. The illuminated shoe 90 also includes the control circuit 100, 102 which is disposed on or within the shoe 90. The control circuit 100, 102 is electrically or optically coupled to the light source 39 to selectively illuminate the light source 39 which in turn illuminates the optically conductive material 32, 33. The structural component 92*a*-92*f* of the shoe 90 may include one or more of a lace, a trim, a strap, a bead, a thong, a sole, an outsole, a heel, a heel counter, a buckle, a tie, a stitch, a tongue, piping, a shawl, a tassel, a tip, a tread, an upper, a logo and an insignia which is formed from the optically conductive material 32, 33. Thus, the structural components 92*a*-92*f* may be formed of the core material 33 of the fiber optic cable 32 or be formed of the fiber optic cable 32. It is contemplated that structural components 92*a*-92*f* of the shoe 90 can be cast, extruded or molded from core material 33 and then jacketed with cladding 35 to create an unconventional (non-cylindrical) fiber optic light conductor such as a curvilinear upper 92*f* or a sole 92*c*.

Alternatively, the fiber optic cable 32 can be embedded into a clear, translucent or opaque material, such as a polymeric material or natural or artificial gel material, which forms a sole or heel 92*c* of the shoe 90 to provide another unique illuminated appearance. Additionally, color pigments or sparkles may be commingled in the polymeric or gel material to create additional visual effects from emitted light being conducted through the material.

Alternatively, shoes 90 or sandals 190 can be formed of any and all types of fiber optic materials which are coupled to a light source 39 driven by a control circuit 100, 102.

Figure 19:
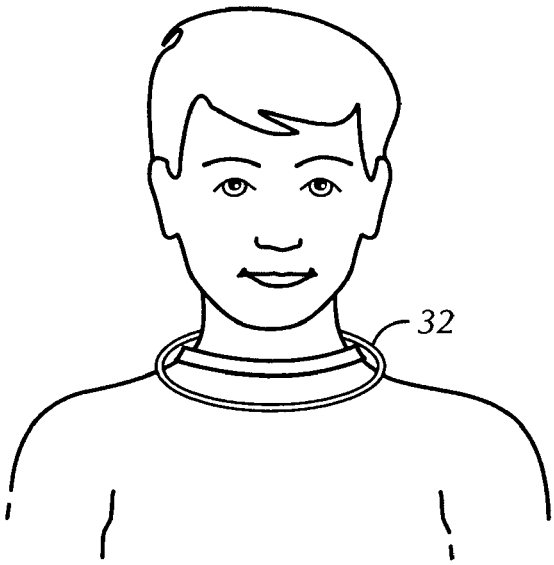
FIG. 19 is a perspective view of an apparatus for illuminating fashion accessories.

Another potential application for the lighting system 30, 130 is for jewelry, belts, suspenders and other fashion accessories (see FIG. 19 for example). The clasp 34, 134 can be utilized to adjust the length of the fiber optic cable 32 and/or to make multiple loops for a necklace, a bracelet, suspenders, a belt and the like. The clasp 34, 134 provides the portable power source BT1-BT3, the control circuit 100, 102 and the ability to connect the fiber optic cable 32 to the LEDs 39. Accordingly, a fiber optic cable 32 used in conjunction with the clasp 34, 134 can create a variety of other applications as will be obvious to one skilled in the art.

From the foregoing, it can been seen that the present inventions comprises an electronic control circuit, apparatuses and methods for illuminating optical fibers and the like disposed in or on shoes and their accessories and for illuminating other accessories such as fashion accessories. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. An apparatus for illuminating shoes or fashion accessories comprising:

a fiber optic cable having a first coupling point and a second coupling point, the fiber optic cable being configured to be affixed to or within a shoe;

a clasp having a housing, a first connector and a second connector, the first connector being configured to couple to the first coupling point of the fiber optic cable and the second connector being configured to couple to the second coupling point of the fiber optic cable;

a control circuit disposed within the housing having a power source and at least one illuminating device, the at least one illuminating device being optically coupled to one or both of the first and second connectors in order to illuminate at least a portion of the fiber optic cable with illuminating light; and a retention mechanism including a spring-loaded push-button, the retention mechanism being operatively coupled with the clasp to retain at least one of the first and second coupling points of the fiber optic cable;

wherein at least one of the clasp and the illuminating device is removable to permit interchangeable selectivity of a color of the illuminating light.

2. The apparatus for illuminating shoes or fashion accessories of claim 1, wherein each of the first and second connectors includes a plurality of fingers and a compression fitting to grasp the first and second coupling points, respectively.

3. The apparatus for illuminating shoes or fashion accessories of claim 1, wherein the control circuit is configured to selectively cause the light source to continuously illuminate and to intermittently illuminate the optically conductive material.

4. The apparatus for illuminating shoes or fashion accessories of claim 1, wherein the power source includes at least one of a battery, a solar cell and a piezoelectric device.

5. The apparatus for illuminating shoes or fashion accessories of claim 1, wherein the fiber optic cable is at least partially tinted one of a plurality of colors selected from the group consisting of white, blue, violet, red, yellow, green and orange.

6. The apparatus for illuminating shoes or fashion accessories of claim 1, wherein the fiber optic cable is generally clear.

7. The apparatus for illuminating shoes or fashion accessories of claim 1, further comprising a lens disposed at least partially in the housing of the clasp, the lens being one of a plurality of colors selected from the group consisting of white, blue, violet, red, yellow, green and orange.

8. The apparatus for illuminating shoes or fashion accessories of claim 1, wherein the at least one illuminating device emits one of a plurality of colors selected from the group consisting of white, blue, violet, red, yellow, green and orange.

* * * * *